US007614988B1

(12) United States Patent
Kiser

(10) Patent No.: US 7,614,988 B1
(45) Date of Patent: Nov. 10, 2009

(54) DECORATIVE, MULTI-FUNCTIONAL EXERCISE AND STORAGE BENCH

(76) Inventor: Mary Kiser, 1409 Havenhurst Dr., Los Angeles, CA (US) 90046

( * ) Notice: Subject to any disclaimer, the term of this patent is extended or adjusted under 35 U.S.C. 154(b) by 0 days.

(21) Appl. No.: 11/561,377

(22) Filed: Nov. 17, 2006

Related U.S. Application Data

(60) Provisional application No. 60/738,320, filed on Nov. 18, 2005.

(51) Int. Cl.
*A63B 26/00* (2006.01)

(52) U.S. Cl. ..... 482/142; 297/108; 108/13; 312/204

(58) Field of Classification Search ..... 482/142, 482/904, 148; D6/432, 440, 448, 336, 349, D6/353, 436; 206/278.1; 144/285; 5/96; D3/272–274, 294–297; 220/23.86, 6, 345.1, 220/108; 297/120, 108, 423.41; 108/86, 108/17, 69; 312/204, 213, 249.1, 8
See application file for complete search history.

(56) References Cited

U.S. PATENT DOCUMENTS 2,990,859 A * 7/1961 Ruben ..... 83/473
5,697,870 A * 12/1997 Osborn ..... 482/52
6,264,586 B1 7/2001 Webber
6,454,683 B1 * 9/2002 Kaye ..... 482/142
6,645,130 B2 11/2003 Webber
2005/0148449 A1 * 7/2005 Weir et al. ..... 482/142
2005/0268398 A1 * 12/2005 Tharalson et al. ..... 5/98.1

* cited by examiner

*Primary Examiner*—Lori Amerson
(74) *Attorney, Agent, or Firm*—Allen D. Hertz

(57) ABSTRACT

A multi-functional exercise bench having a storage section that can store exercise equipment such as weights, jump ropes, water bottles, yoga mats, decorative hand weights, yoga mats, resistance bands, etc. The bench includes a riser platform that provides an angled surface that the user can lay on while exercising. The riser platform is hinged at one end of the bench. Additionally, a storage cover can be included, being hinged at the rear of the bench. The multi-functional exercise bench can include weight support members as well as leg exercise devices. These weight holding exercise members can be collapsible and capable of being stored inside the storage section. The bench is covered in aesthetically pleasing materials to match the décor of the room.

20 Claims, 4 Drawing Sheets

DECORATIVE, MULTI-FUNCTIONAL EXERCISE AND STORAGE BENCH

RELATED US PATENT INFORMATION

This application claims priority to Provisional Application No. 60,738,320 filed on Nov. 18, 2005 and is incorporated herein by reference.

FIELD OF THE INVENTION

The present invention relates generally to an exercise bench comprising a storage area.

BACKGROUND OF THE INVENTION

This invention relates to an exercise weight bench that doesn't look like an exercise weight bench. The two major segments of the $3 billion U.S. fitness industry are the home market and the institutional exercise equipment market (including health clubs, corporations, apartments, and hotels.) The majority of Americans who exercise do so at home. In recent years, the home gym has become very popular. However, since most people do not have room for a separate gym in their home, they devote a portion of their bedroom, den, or basement as the exercise area.

Webber (U.S. Pat. Nos. 6,264,586 & 6,645,130) illustrates a large exercise machine that can be collapsed and stored. Webber teaches a large device still requiring storage away from view. Webber teaches an apparatus that an unsightly piece of exercise equipment.

What is desired is an exercise bench that blends with the décor of the room. Further desired is an exercise bench that provides a storage area allowing the user to store exercise equipment in an aesthetically pleasing manner.

SUMMARY OF THE INVENTION

Accordingly, the present invention provides an exercise bench, wherein said exercise bench further comprising a storage area.

A first aspect of the present invention is an exercise bench that is an attractive piece of furniture that you want to be seen. The look of the equipment is designed to blend in with the décor of the room, rather than stand out as a piece of exercise equipment.

A second aspect of the present invention is an exercise bench comprising a storage area.

A third aspect of the present invention is an exercise bench comprising a storage area, said exercise bench further comprising an exercise riser platform above said storage area.

A fourth aspect of the present invention is an exercise bench comprising a storage area, said exercise bench further comprising an exercise riser platform above said storage area, wherein said exercise riser platform is hinged, allowing said exercise riser platform to rotate about a length of said bench.

A fifth aspect of the present invention is an exercise bench comprising a storage area, said exercise bench further comprising an exercise riser platform above said storage area, wherein said exercise riser platform is hinged at one end of the exercise bench, allowing said exercise riser platform to rotate about a length of said bench.

A sixth aspect of the present invention is an exercise bench comprising a storage area, said exercise bench further comprising an exercise riser platform above said storage area, wherein said exercise riser platform is hinged at one end (left or right) of the exercise bench, allowing said exercise riser platform to rotate about a length of said bench, incorporating an angle securing member.

A seventh aspect of the present invention is an exercise bench comprising a storage area, said exercise bench further comprising an exercise riser platform above said storage area, wherein said exercise riser platform is hinged at one end of the exercise bench, allowing said exercise riser platform to rotate about a length of said bench, incorporating an angle securing member, wherein said angle securing member is a support bar and a notched adjusting member.

An eighth aspect of the present invention is an exercise bench comprising a storage area, said exercise bench further comprising an exercise riser platform above said storage area, wherein said exercise riser platform is hinged at one end of the exercise bench, allowing said exercise riser platform to rotate about a length of said bench, incorporating an angle securing member, wherein said angle securing member is a support bar and a series of apertures in a weight supporting member.

A ninth aspect of the present invention is an exercise bench covered in attractive fabrics and colors such as ultra-suede and velvet and popular patterns such as leopard, toile, floral, and others.

A tenth aspect of the present invention is an exercise bench further comprising college emblems and pro sports team logos.

An eleventh aspect of the present invention is an exercise bench further comprising a storage area for storing exercise equipment such as weights, jump ropes, water bottles, yoga mats, decorative hand weights, yoga mats, resistance bands, and the like.

A twelfth aspect of the present invention is an exercise bench further comprising a pair of weight stands for holding a bench press bar.

A thirteenth aspect of the present invention is an exercise bench further comprising a leg exercise apparatus.

A fourteenth aspect of the present invention is an exercise bench further comprising a storage cover.

A fifteenth aspect of the present invention is an exercise bench further comprising a storage cover, wherein said storage cover is rotationally coupled to a rear of the storage area.

A fifteenth aspect of the present invention is an exercise bench comprising a storage cover and an exercise riser platform.

A sixteenth aspect of the present invention is an exercise bench comprising a storage cover which opens by rotating upwards, towards the rear and an exercise riser platform that rotates from at least one of a right side and a left side of said exercise bench.

An eighteenth aspect of the present invention is an exercise bench comprising at least one of said exercise bench riser platform and said storage bench cover comprise a recess for said elevation securing member(s) allowing said exercise bench riser platform to close onto said storage bench cover.

A seventeenth aspect of the present is an exercise bench comprising an elevation securing member, wherein said elevation securing member comprising a first elevation securing section is coupled to said exercise bench riser platform and a second elevation securing section is coupled to said storage bench cover.

The disclosed aspects of the present invention define each aspect individually, wherein it is understood that each of the aspects can be combined to provide various embodiments of an exercise bench with storage.

BRIEF DESCRIPTION OF THE DRAWINGS

The present invention, together with further objects and advantages thereof may best be understood by reference to the following description taken in conjunction with the accompanying drawings in which.

Various like features are shown throughout the drawings. It is recognized that the features described herein can be combined into a single apparatus.

DETAILED DESCRIPTION OF THE INVENTION

Figure 1:
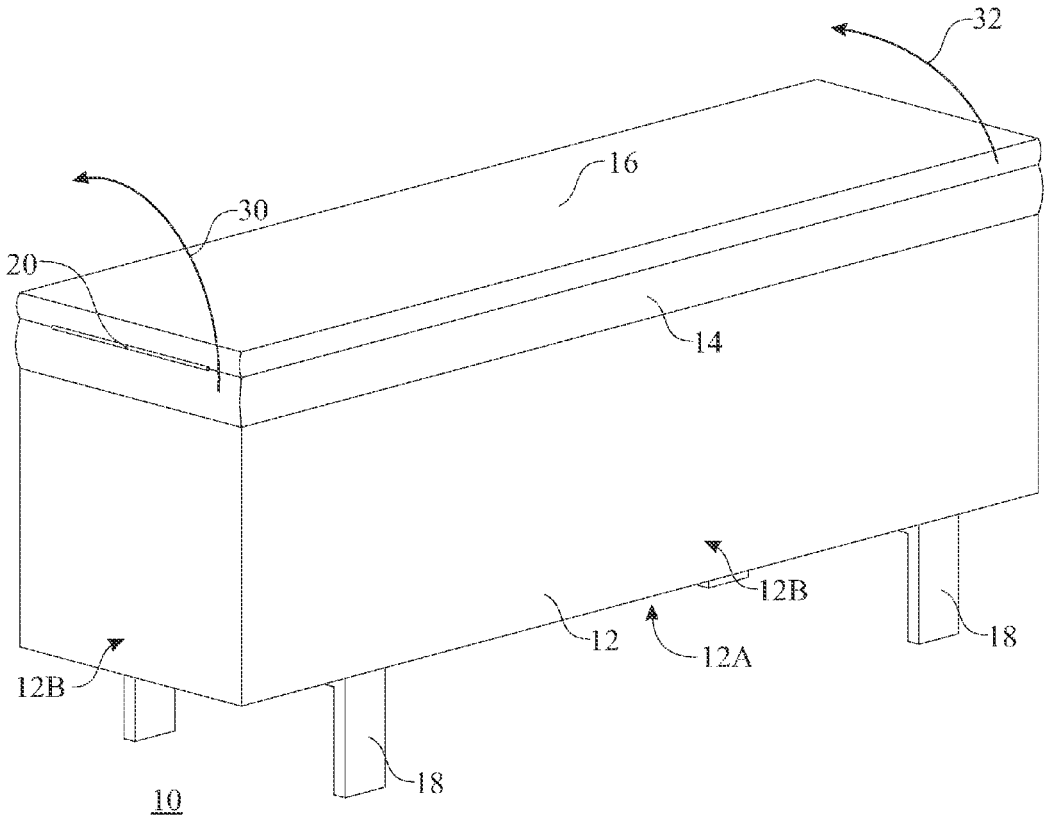
FIG. 1 presents an isometric view illustrating a multi-functional exercise and storage bench, illustrated in a closed position.

FIG. 1 presents an isometric view of an exercise storage bench 10. Said exercise storage bench 10 comprising a storage bench base 12 which is covered by at least one of a storage bench cover 14 and an exercise bench riser platform 16. The preferred embodiment would comprise both said storage bench cover 14 and said exercise bench riser platform 16. Said storage bench base 12 comprises a bottom member 12A and a sidewall member 12B. Said storage bench base 12 provides a storage section for storing of exercise equipment such as weights, jump ropes, water bottles, yoga mats, decorative hand weights, yoga mats, resistance bands, and the like. Said storage bench cover 14 provides an easy access to said storage section of said exercise storage bench 10, via a storage bench cover rotation 30, as will be shown later herein. Said exercise bench riser platform 16 provides a riser platform which supports an exercising party at an angle via an exercise bench riser rotation 32. Said exercise bench riser platform 16 is rotationally coupled to one of said storage bench base 12 and said storage bench cover 14 via an exercise bench riser hinge 20. Said exercise storage bench 10 is supported by a set of storage bench legs 18.

Said storage bench base 12, storage bench cover 14 and exercise bench riser platform 16 are manufactured of a rigid framing material such as wood, fiberglass, polycarbonate, composite material, and the like. Said storage bench base 12, storage bench cover 14 and exercise bench riser platform 16 are then preferably covered with a padding and subsequent material. Said material can be any of attractive fabrics and colors including, but not limited to leather, ultra-suede and velvet and in popular patterns such as leopard, toile, floral, and the like. Additionally, said exercise storage bench 10 can be adorned with various sports logos such as college emblems, pro sports team logos, and the like.

Figure 2:
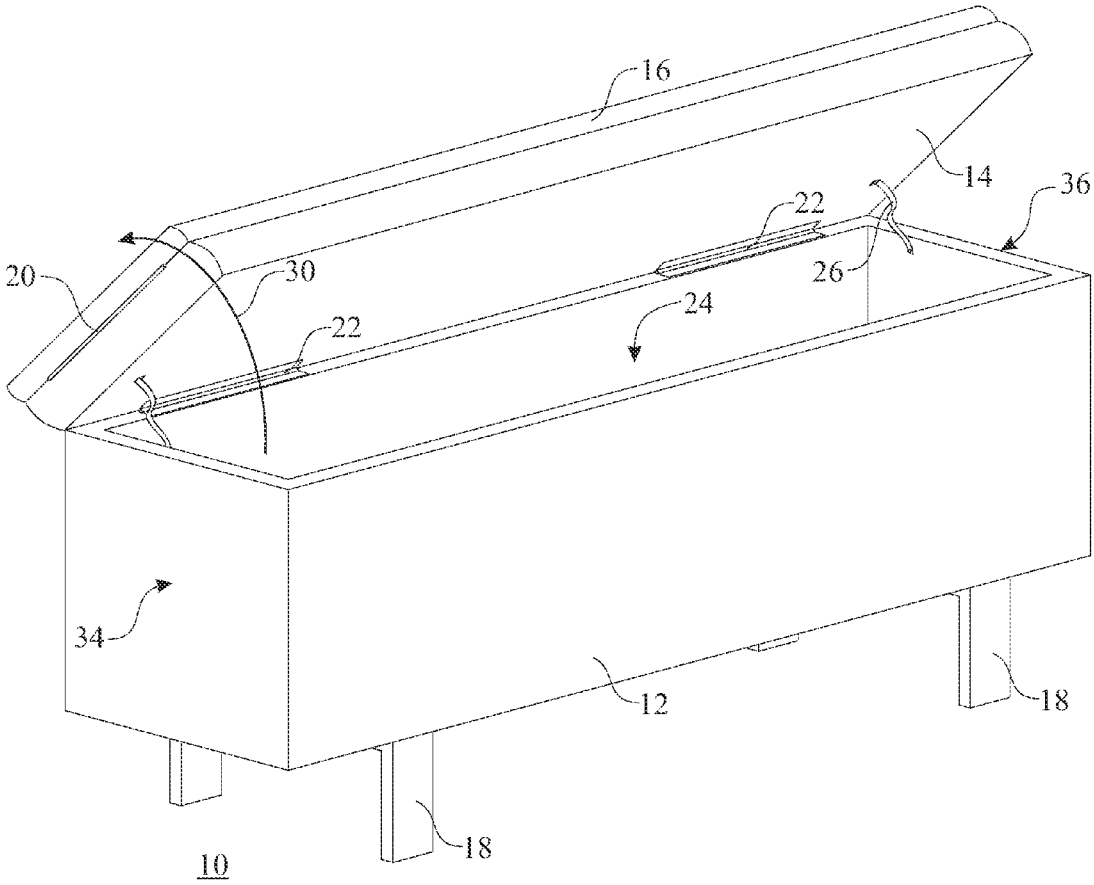
FIG. 2 presents an isometric view illustrating said multi-functional exercise and storage bench, demonstrating the motion to access the storage section.

FIG. 2 presents an isometric view of said exercise storage bench 10 illustrating access to a storage section 24. Said storage bench cover 14 opens via said storage bench cover rotation 30; rotationally coupled to a back proximity of said storage bench base 12 via at least one storage bench cover hinge 22. Said storage bench cover 14 is maintained from rotating too far via at least one storage bench cover straps 26, wherein said storage bench cover straps 26 is coupled to said storage bench cover 14 and said storage bench base 12. Said storage bench cover straps 26 can be of any known means wherein a simple ribbon is shown herein. By including said storage bench cover 14 in this configuration, said exercise storage bench 10 provides easy access to said storage section 24.

Figure 3:
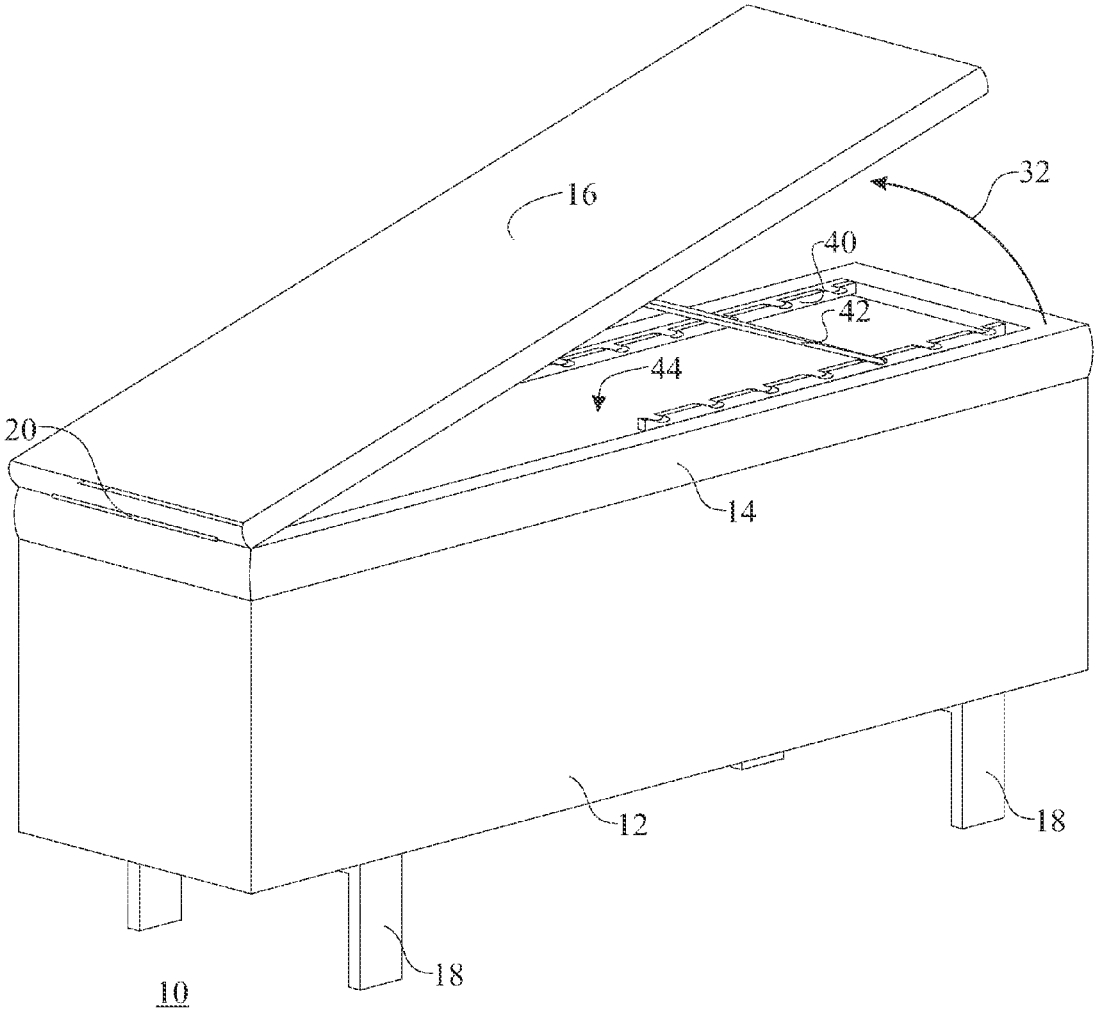
FIG. 3 presents an isometric view illustrating said multi-functional exercise and storage bench, demonstrating the motion to position an exercise riser platform and an angle securing member.

FIG. 3 presents an isometric view of said exercise storage bench 10 illustrating said exercise bench riser platform 16 in an elevated orientation. Said exercise bench riser platform 16 is rotationally coupled to one of said storage bench cover 14 and said storage bench base 12 via said exercise bench riser hinge 20, wherein said exercise bench riser hinge 20 can be located proximate at one of an exercise bench left side 34 and an exercise bench right side 36. Said exercise bench riser platform 16 is adjusted in accordance with an exercise bench riser rotation 32, being supported via an exercise bench riser bar 42 placed into a notch within an exercise bench notched riser clip 40. The preferred embodiment secures two sections of said exercise bench notched riser clip 40 to a top surface of said storage bench cover 14. Said exercise bench riser bar 42 would comprise a "U" shaped member that places the bottom section of said exercise bench riser bar 42 in the notch of said exercise bench notched riser clip 40. The opposing end(s) of said exercise bench riser bar 42 are coupled to said exercise bench riser platform 16 in a manner wherein said exercise bench riser bar 42 can pivot. It is recognized that an alternate means for maintaining said exercise bench riser platform 16 in an elevated orientation can be utilized and should be considered within the spirit and scope of the present invention. One such alternate elevation securing member would be a telescoping member with an adjustable locking position (not shown). Additional alternate versions of an elevation securing member can be described as a first securing elevation member and a second elevation securing member, wherein said a first securing elevation section is coupled to said exercise bench riser platform 16 and a second elevation securing section is secured to said storage bench cover 14. Further, at least one of said exercise bench riser platform and said storage bench cover can comprise an elevation securing member recess 44 for said elevation securing member(s), allowing said exercise bench riser platform to close onto said storage bench cover.

Figure 4:
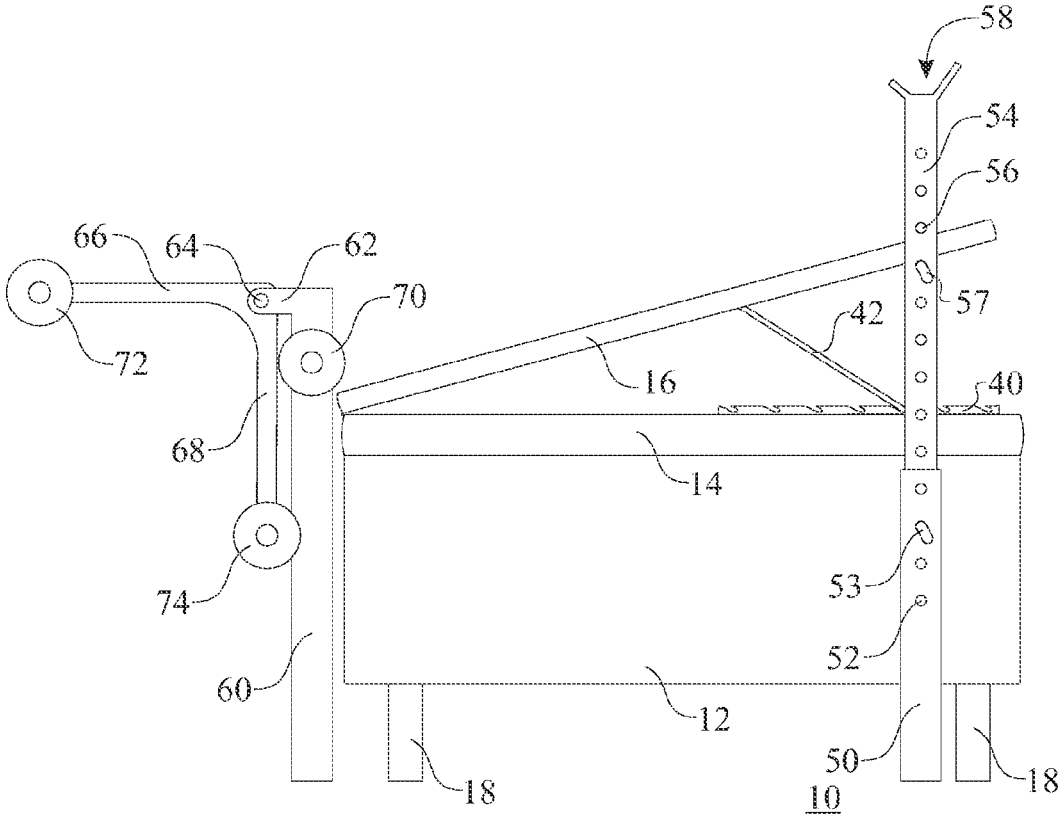
FIG. 4 presents an elevation view of said multi-functional exercise and storage bench, introducing additional exercise devises.

FIG. 4 presents an elevation view of said exercise storage bench 10, introducing additional exercise members as well as an alternate means for maintaining said exercise bench riser platform 16 in an elevated orientation as well as providing weight holding apparatus as additional devices for exercises. Said exercise storage bench 10 further comprising a pair of weight support columns, wherein said weight support columns comprise a weight support column base member 50, a weight support column extension member 54 and a weight bar support section 58. Said weight support column extension member 54 is vertically adjustable within said weight support column base member 50 and secured at a desired height via a weight support column adjustment pin 53 placed through both said weight support column base adjustment apertures 52 and a weight support column extension member apertures 56 of said weight support column extension member 54. A weight support column riser platform support pin 57 can be placed within said weight support column extension member apertures 56 providing an alternate means for supporting said exercise bench riser platform 16 in an elevated orientation. It is preferable that said weight support columns are collapsible and stored in said storage section 24 (see FIG. 2) of said storage bench base 12.

FIG. 4 additionally introduces a leg exercise apparatus, said leg exercise apparatus comprising a leg exercise support column 60, wherein said leg exercise support column 60 comprising a leg exercise support coupling member 62. Additionally an upper leg support member 70 can be coupled to said leg exercise support column 60, wherein said upper leg support member 70 provides support to an upper leg section of an exercising party. Said upper leg support member 70 would preferably be of a padded material, such as foam, for comfort. The exercise portion comprising a leg exercise horizontal beam 66 and a leg exercise vertical beam 68, both coupled to said leg exercise support coupling member 62 via a leg exercise support coupling pin 64. Said leg exercise horizontal beam 66 and said leg exercise vertical beam 68 can be of a single member as illustrated. A horizontal beam leg support member 72 is coupled to said leg exercise horizontal beam 66 providing the user a gripping surface when lying face down on said exercise storage bench 10. A vertical beam leg support member 74 is coupled to said leg exercise vertical beam 68 providing the user a gripping surface when facing upwards or sitting upright on said exercise storage bench 10. It is preferable that said leg exercise apparatus is collapsible and stored in said storage section 24 (see FIG. 2) of said storage bench base 12.

Various changes may be made to the embodiments shown herein without departing from the scope of the present invention, which is limited only by the following claims.

What is claimed:

1. A multi-functional exercise bench, said multi-functional exercise bench for supporting an individual comprising:

a sidewall being generally vertically oriented, comprising a front wall, a left wall, a rear wall, and a right wall, the front and rear walls having a substantially longer horizontal dimension than the left and right side walls, wherein the front wall, a left wall, a rear wall, and a right wall having each edge assembled to a respective edge of the adjacent wall forming one contiguous tubular vertical structure;

a storage bench section including the sidewall and a bottom member assembled proximate a lower edge of said sidewall, the storage bench section provided for storing objects;

a storage bench cover dimensioned to provide a cover for said storage bench section, wherein said storage bench cover is pivotally assembled to said rear wall, rotating about an axis that is parallel to a horizontal longitudinal axis of the rear wall, thus providing a cover for said storage bench section;

an exercise bench riser platform formed having a substantially rigid, generally planar upper surface and dimensioned to cover the storage bench cover, wherein an upper surface of the exercise bench riser platform is padded;

wherein said exercise bench riser platform is positioned above and pivotally coupled to said storage bench cover at either a left edge of said storage bench cover or a right edge of said storage bench cover;

wherein the exercise bench riser platform pivots along an axis that is perpendicular to the pivoting axis of the storage bench cover; and an elevation securing member for securing said exercise bench riser platform at an angle for use by an individual, wherein the individual is configured to recline in a supine position adjacent the padded upper surface of the exercise bench riser platform during an exercise routine.

2. The multi-functional exercise bench of claim 1 wherein said elevation securing member comprising a first elevation securing section and is coupled to said exercise bench riser platform and a second elevation securing section is coupled to said storage bench cover.

3. The multi-functional exercise bench of claim 2 wherein at least one of said exercise bench riser platform and said storage bench cover comprise a recess for said elevation securing member allowing said exercise bench riser platform to close onto said storage bench cover.

4. A multi-functional exercise bench, said multi-functional exercise bench for supporting an individual comprising:

a sidewall being generally vertically oriented, comprising a front wall, a left wall, a rear wall, and a right wall, the front and rear walls having a substantially longer horizontal dimension than the left and right side walls, wherein the front wall, a left wall, a rear wall, and a right wall having each edge assembled to a respective edge of the adjacent wall forming one contiguous tubular vertical structure;

a storage bench section including the sidewall and a bottom member assembled proximate a lower edge of said sidewall, the storage bench section provided for storing objects;

a storage bench cover dimensioned to provide a cover for said storage bench section, wherein said storage bench cover is pivotally assembled to said rear wall, rotating about an axis that is parallel to a horizontal longitudinal axis of the rear wall, thus providing a cover for said storage bench section;

an exercise bench riser platform formed having a substantially rigid, generally planar upper surface and dimensioned to cover the storage bench cover, wherein an upper surface of the exercise bench riser platform is padded;

wherein said exercise bench riser platform is positioned above and pivotally coupled to said storage bench cover at either a left edge of said storage bench cover or a right edge of said storage bench cover;

wherein the exercise bench riser platform pivots along an axis that is perpendicular to the pivoting axis of the storage bench cover;

an elevation securing member for securing said exercise bench riser platform at an angle for use by an individual, wherein the individual is configured to recline in a supine position adjacent the padded upper surface of the exercise bench riser platform during an exercise routine; and wherein at least a portion of said storage bench section is padded.

5. The multi-functional exercise bench of claim 4 wherein said elevation securing member comprising a first elevation securing section and is coupled to said exercise bench riser platform and a second elevation securing section is coupled to said storage bench cover.

6. The multi-functional exercise bench of claim 5 wherein at least one of said exercise bench riser platform and said storage bench cover comprise a recess for said elevation securing member allowing said exercise bench riser platform to close onto said storage bench cover.

7. The multi-functional exercise bench of claim 1, said multi-functional exercise bench further comprising a weight holding apparatus.

8. The multi-functional exercise bench of claim 7 wherein said weight holding apparatus is at least one of a weight support column and a leg exercise apparatus.

9. The multi-functional exercise bench of claim 8 wherein said at least one of a weight support column and a leg exercise apparatus are collapsible into a shape and size capable of being stored within said storage bench section of said multi-functional exercise bench.

10. The multi-functional exercise bench of claim 9, said multi-functional exercise bench further comprising an elevation securing member, wherein said elevation securing member is coupled to said weight support column.

11. The multi-functional exercise bench of claim 1 wherein at least a portion of said storage bench section is covered in a padding and material.

12. The multi-functional exercise bench of claim 4, said multi-functional exercise bench further comprising a weight holding apparatus.

13. The multi-functional exercise bench of claim 12 wherein said weight holding apparatus is at least one of a weight support column and a leg exercise apparatus.

14. The multi-functional exercise bench of claim 13 wherein said at least one of a weight support column and a leg exercise apparatus are collapsible into a shape and size capable of being stored within said storage bench section of said multi-functional exercise bench.

15. The multi-functional exercise bench of claim 14, said multi-functional exercise bench further comprising an elevation securing member, wherein said elevation securing member is coupled to said weight support column.

16. A multi-functional exercise bench, said multi-functional exercise bench for supporting an individual comprising:

a sidewall being generally vertically oriented, comprising a front wall, a left wall, a rear wall, and a right wall, the front and rear walls having a substantially longer horizontal dimension than the left and right side walls, wherein the front wall, a left wall, a rear wall, and a right wall having each edge assembled to a respective edge of the adjacent wall forming one contiguous tubular vertical structure;

a storage bench section including the sidewall and a bottom member assembled proximate a lower edge of said sidewall, the storage bench section provided for storing objects;

a storage bench cover dimensioned to provide a cover for said storage bench section, wherein said storage bench cover is pivotally assembled to said rear wall, rotating about an axis that is parallel to a horizontal longitudinal axis of the rear wall, thus providing a cover for said storage bench section;

an exercise bench riser platform formed having a substantially rigid, generally planar upper surface and dimensioned to cover the storage bench cover, wherein an upper surface of the exercise bench riser platform is padded;

wherein said exercise bench riser platform is positioned above and pivotally coupled to said storage bench cover at either a left edge of said storage bench cover or a right edge of said storage bench cover;

wherein the exercise bench riser platform pivots along an axis that is perpendicular to the pivoting axis of the storage bench cover;

an elevation securing member for securing said exercise bench riser platform at an angle for use by an individual, wherein the individual is configured to recline in a supine position adjacent the padded upper surface of the exercise bench riser platform during an exercise routine; and a weight holding apparatus for holding a weight at a distance from said exercise bench riser platform.

17. The multi-functional exercise bench of claim 16 wherein said weight holding apparatus is at least one of a weight support column and a leg exercise apparatus.

18. The multi-functional exercise bench of claim 16 wherein said at least one of a weight support column and a leg exercise apparatus are collapsible into a shape and size capable of being stored within said storage bench section of said multi-functional exercise bench.

19. The multi-functional exercise bench of claim 16, wherein said weight holding apparatus is a weight support column;

said multi-functional exercise bench further comprising and an elevation securing member; and wherein said elevation securing member is coupled to said weight support column.

20. The multi-functional exercise bench of claim 16 wherein at least a portion of said multi-functional exercise bench is covered in a padding and material.

* * * * *